US005121719A

United States Patent [19]

Okazaki et al.

[11] Patent Number: 5,121,719

[45] Date of Patent: Jun. 16, 1992

[54] START BOOSTING DEVICE FOR INTERNAL COMBUSTION ENGINE

[75] Inventors: Masaki Okazaki; Hiroaki Fujimoto, both of Hamamatsu, Japan

[73] Assignee: Sanshin Kogyo Kabushiki Kaisha, Shizuoka, Japan

[21] Appl. No.: 671,152

[22] Filed: Mar. 18, 1991

Related U.S. Application Data

[63] Continuation of Ser. No. 382,088, Jul. 19, 1989, abandoned.

[30] Foreign Application Priority Data

Jul. 20, 1988 [JP] Japan ..... 63-180671

[51] Int. Cl.[5] ..... F02M 1/16

[52] U.S. Cl. ..... 123/179.14; 123/179.18; 123/585

[58] Field of Search ..... 123/180 R, 585, 180 P, 123/180 E, 180 A, 179 G, 179 L

[56] References Cited

U.S. PATENT DOCUMENTS

| | | | |
|---|---|---|---|
| 1,191,062 | 7/1916 | Clark et al. | 123/180 R |
| 2,905,165 | 9/1959 | Hall | 123/179 G |
| 3,020,905 | 2/1962 | Göschel et al. | 123/180 P |
| 3,494,340 | 2/1970 | Weber et al. | 123/179 L |
| 3,614,945 | 10/1971 | Schlagmüller et al. | 123/179 L |
| 4,157,084 | 6/1979 | Wallis | 123/179 G |

*Primary Examiner*—Andrew M. Dolinar
*Attorney, Agent, or Firm*—Ernest A. Beutler

[57] ABSTRACT

A number of embodiments of outboard motors incorporating fuel and air enrichment devices in which fuel is supplied to the engine for enrichment under pressure by a pump and additional air is also supplied to the engine induction system at least at atmospheric pressure. In some embodiments, the air is mixed with the fuel and is pressurized. The fuel and air flow are both controlled by a common valve member that may be operated either by a solenoid or a heated wax pellet.

17 Claims, 8 Drawing Sheets

START BOOSTING DEVICE FOR INTERNAL COMBUSTION ENGINE

This is a continuation of U.S. Pat. application Ser. No. 382,088, filed Jul. 19, 1989, now abandoned.

BACKGROUND OF THE INVENTION

This invention relates to a start boosting device for an internal combustion engine and more particularly to an improved enrichment device for an internal combustion engine.

It is well known to supply enrichment fuel to an internal combustion engine under certain conditions. For example, enrichment fuel is normally provided so as to assist in starting and/or for cold running warm up. Generally the enrichment fuel is supplied to the engine only at atmospheric or slightly greater than atmospheric pressure. However, the supply of enrichment fuel at these low pressures is not always sufficient to insure the desired running or starting of the engine. Although pumping devices have been incorporated for assisting in the supply of enrichment fuel, these pumping devices generally are "one shot" types of devices that only provide a finite amount of fuel under pressure. These devices also are not fully satisfactory.

Even if enrichment fuel is supplied to the engine at an elevated pressure, this may be not be sufficient so as to insure proper engine operation. For example, if the enrichment fuel supply is pressured, the mixture supplied to the engine may be too rich.

It is, therefore, a principal object of this invention to provide an improved enrichment system for an internal combustion engine.

It is another object of this invention to provide an enrichment system wherein both fuel and excess air are supplied to the engine in response to the desired condition.

Where both additional fuel and air are supplied to the engine and the fuel is pressurized, it must be insured that the pressurized fuel does not flow out of the air enrichment system rather than to the engine. It is, therefore, a still further object of this invention to provide an improved arrangement for supplying both excess fuel and air to an engine under certain conditions and wherein the pressurized fuel cannot flow into the excess air system.

SUMMARY OF THE INVENTION

This invention is adapted to be embodied in an enrichment system for an internal combustion engine having an induction system and a charge forming device for supplying a fuel/air mixture to the induction system. Means are provided for selectively supplying enrichment fuel to the inductive system at a pressure substantially greater than atmospheric. Means also supply enrichment air to the induction system at least at atmospheric pressure in response to the supply of enrichment fuel.

DETAILED DESCRIPTION OF THE PREFERRED EMBODIMENTS

Figure 1:
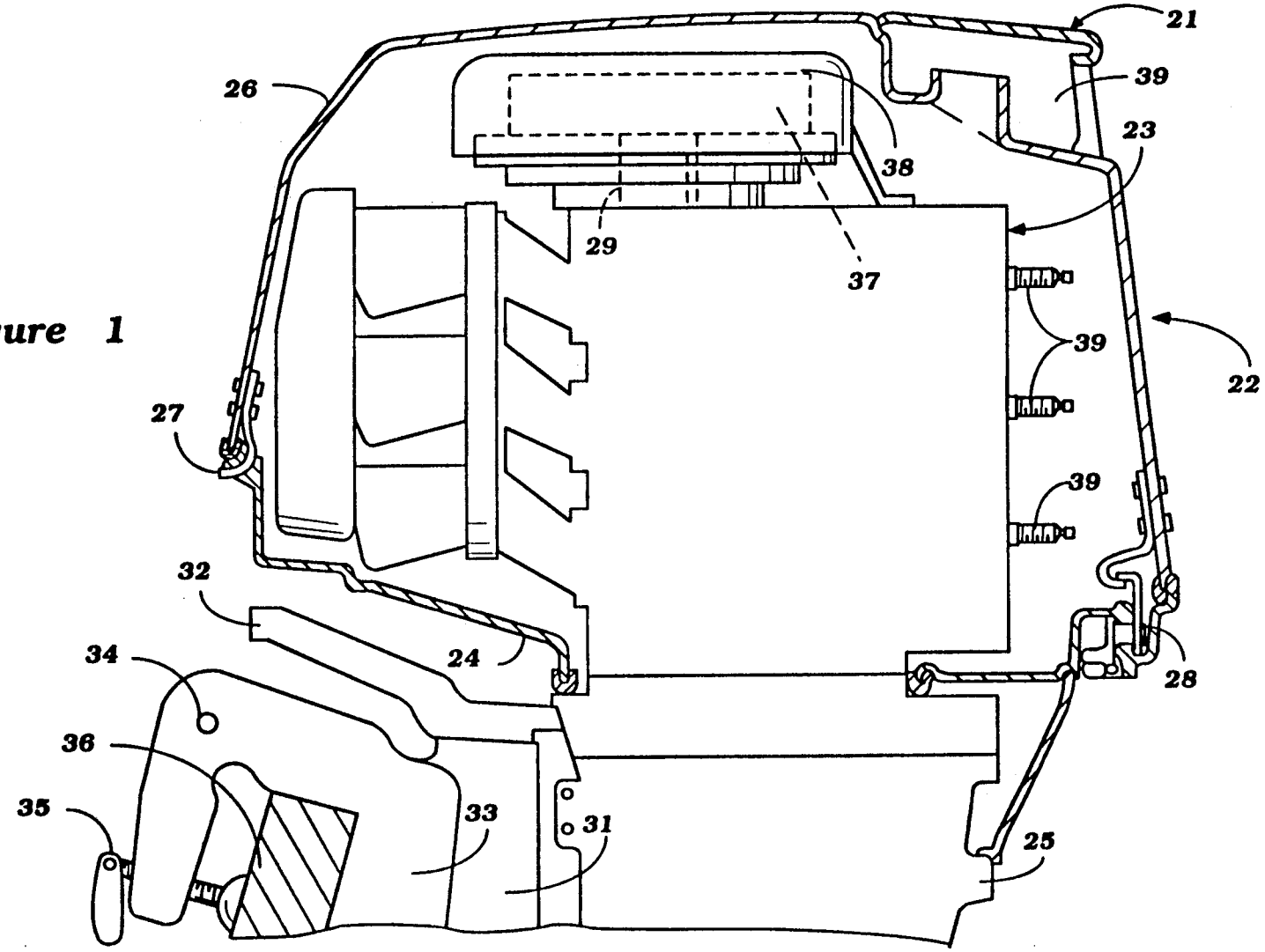
FIG. 1 is a partial side elevational view of an outboard motor attached to the transom of a watercraft and constructed in accordance with an embodiment of the invention, with a portion broken away.

Referring first to FIG. 1, an outboard motor constructed in accordance with an embodiment of the invention is identified generally by the reference numeral 21. The invention is described in conjunction with an outboard motor because such outboard motors are typical examples of environments in which the invention may be utilized. It is to be understood, however, that the invention can be utilized in conjunction with other applications for internal combustion engine.

The outboard motor 21 is comprised of a power head, indicated generally by the reference numeral 22 that contains an internal combustion engine 23 constructed in accordance with an embodiment of the invention. Inasmuch as the invention relates to the engine 23, the outboard motor 22 has not been shown completely. The power head 22 further includes an outer or protective housing including a tray part 24 that is supported on the upper end of a drive shaft housing 25 in a known manner. A main cover portion 26 is detachably connected to the tray 24 by means of a hook 27 and releasable latch mechanism 28.

The engine 23 has its crankshaft 29 rotatable about a vertically extending axis and which is coupled to a drive shaft (not shown) that is journaled in the drive shaft housing 25. This drive shaft drives a propulsion unit that is contained within the lower unit, all of which components are not shown for the aforenoted reason.

A swivel bracket 31 journals a steering shaft (not shown) that is affixed to the drive shaft housing 25 in a known manner for steering of the outboard motor 21 and the associated watercraft. A steering tiller 32 is affixed to the steering shaft for this purpose. The swivel bracket 31 is pivotally connected to a clamping bracket 33 by means of a horizontal disposed tilt pin 34 for tilt and trim movement of the outboard motor 21 in a known manner. A clamp 35 that is connected to the clamping bracket 33 detachably affixes the outboard motor 21 to a transom 36 of the associated watercraft.

A flywheel magneto assembly 37 is affixed to the upper end of the crankshaft 29 and is contained within a flywheel cover 38 for firing the spark plugs 39 of the engine 23 via a suitable ignition system. The outer housing and particularly the main cover portion 26 is provided with an air inlet opening 39 so that induction air can be drawn into the interior of the outer cowling for the engine 23.

Figure 2:
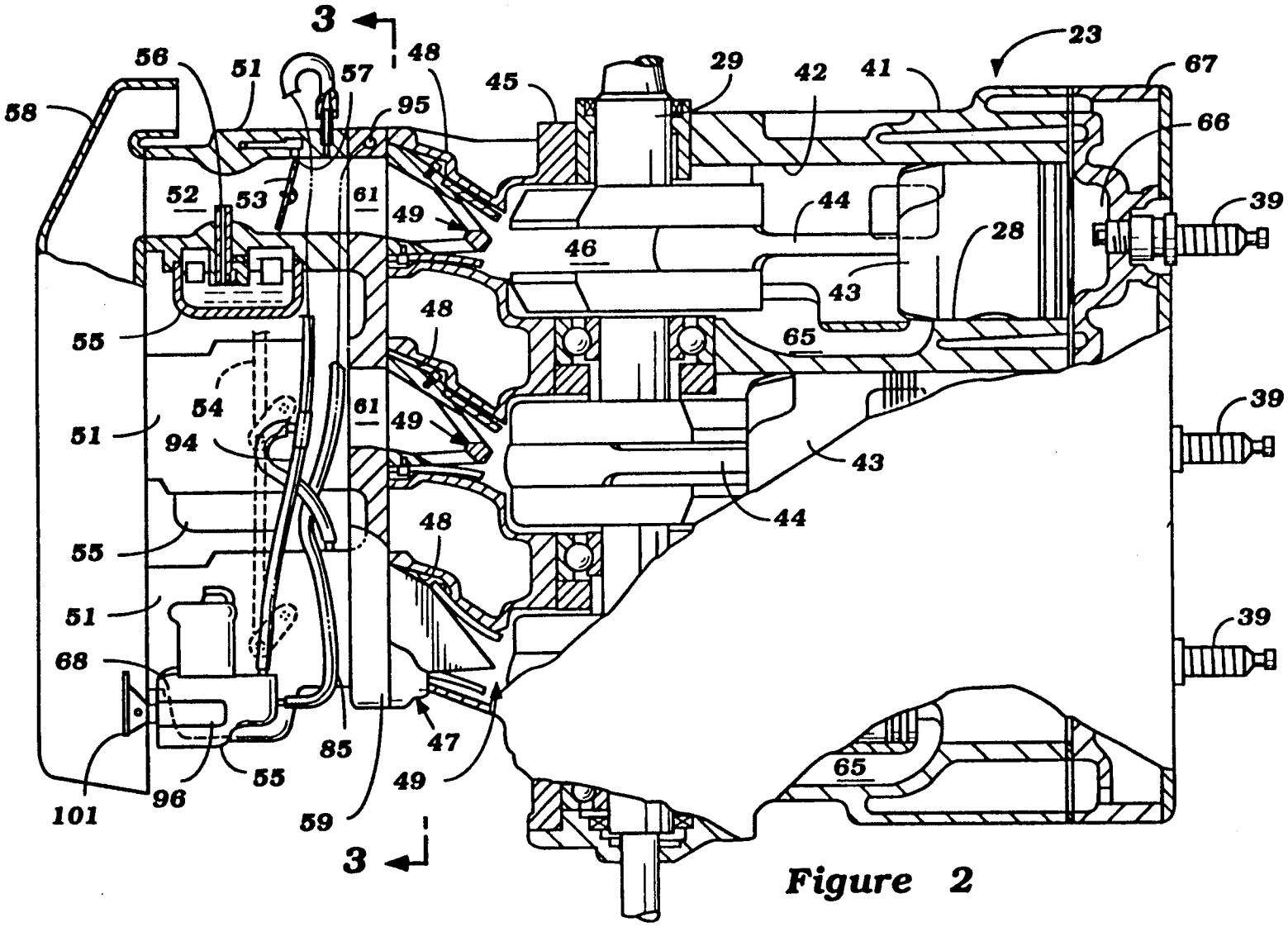
FIG. 2 is an enlarged side elevational view of the engine, with portions broken away and shown in section.

Referring now in detail to FIG. 2, the engine 23 is depicted as being of the three cylinder in-line crankcase compression two cycle type. It is to be understood, however, that the invention may be practiced in conjunction with engine shaving other cylinder numbers or even rotary type engines, and also with engines operating on other than the two stroke crankcase compression principle. However, the invention has particular utility with two cycle crankcase compression engines.

Figure 3:
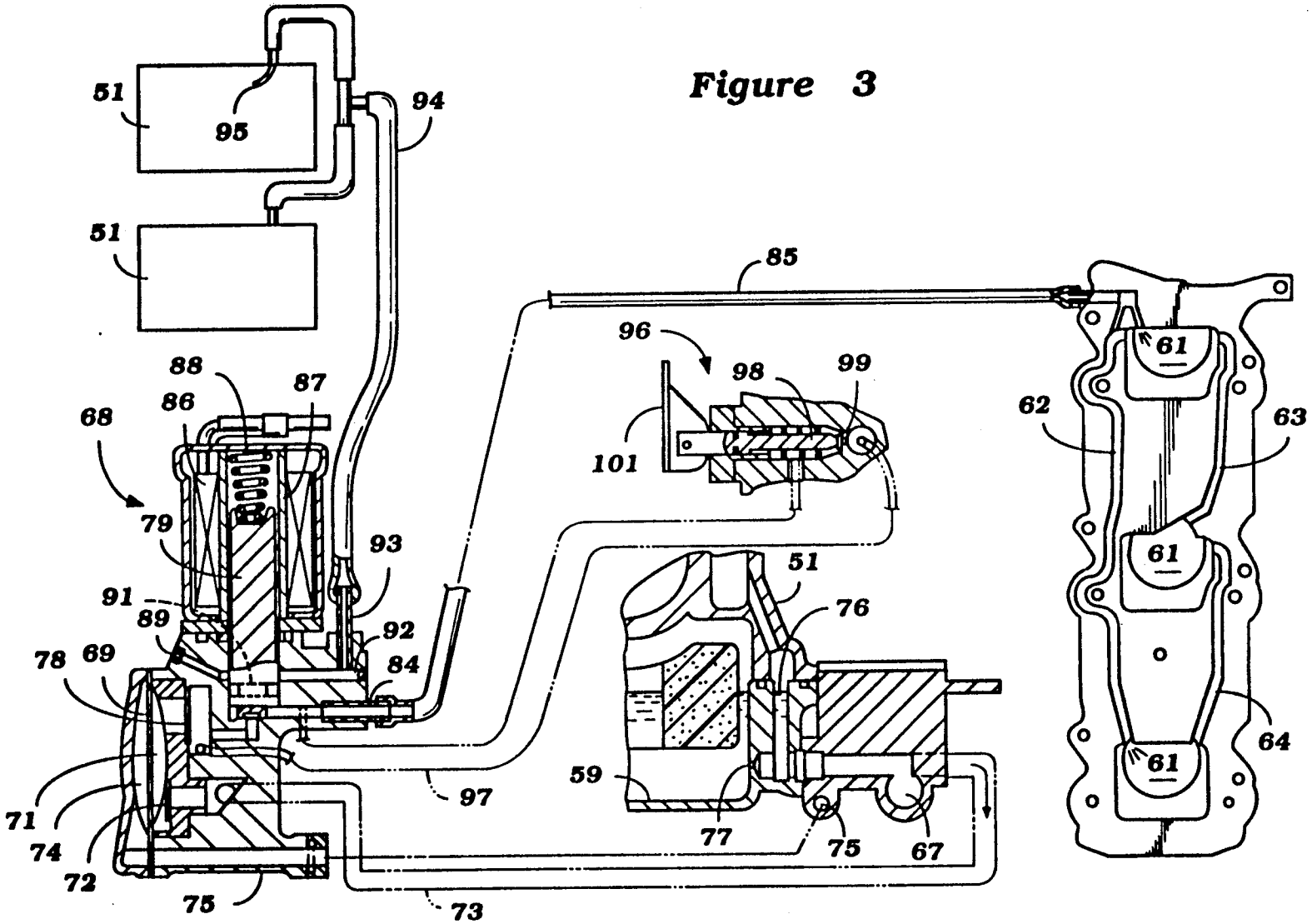
FIG. 3 is a partially schematic cross-sectional view taken along the line 3—of FIG. 2.

Referring now primarily to FIGS. 2 and 3 and initially primarily to FIG. 2, the engine 23 is comprised of a cylinder block 41 in which three vertically spaced cylinder bores 42 are formed. Pistons 43 reciprocate in the cylinder bores 42 and are connected by means of connecting rods 44 to a respective throw of the crankshaft 29. The crankshaft 29 is rotatably journaled beneath the cylinder block 41 by space bearings supported within the cylinder block 41 and a crankcase 45 that is affixed to the cylinder block 41 in a known manner. As is common with two cycle crankcase compressions, the crankcase chamber is divided into three individual sealed chambers 46, one associated with each of the pistons 43.

An intake manifold 47 is affixed to the crankcase 45 and has three individual passages 48, each of which runs to a respective one the crankcase chambers 46. Reed type check valves 49 are positioned in the passages 48 so as to preclude reverse flow, as is well known in this art.

A charge is delivered to each of the manifold passages 48 from a respectively carburetor 51. The carburetors 51 may have any known type of construction and generally are comprised of intake passages 52 in which throttle valves 53 are positioned for controlling the flow through the intake passages 52. The throttle valves 53 are operated in unison by means of a linkage system 54 from a remote operator (not shown). A fuel bowl 55 is positioned beneath each of the carburetor intake passages and contains a level of fuel that is held at a fixed head by means of a float operated valve, as is well known. The fuel is delivered to the intake passages 52 from the fuel bowl 55 through a main fuel discharge 56 ad also through an idle fuel discharge 57.

An air intake device 58 is affixed to the carburetors 51 for silencing the intake air that is delivered to the engine. A spacer plate 59 is interposed between the carburetors 51 and the intake manifold 47. The spacer plate 59 has individual passages 61 that are aligned with the carburetor intake passages 52 and the manifold intake passages 48.

Balance passageways 62, 63 and 64 (FIG. 3) interconnect the spacer plate passages 61 with each other so as to avoid pressure fluctuations in the induction system and to tend to maintain a more uniform induction system vacuum.

The fuel/air charge which is delivered to the crankcase chambers 49 is transferred to the area above the pistons 43 through one or more scavenge or transfer passages 65 that are formed in the cylinder block 41 and which extend from the crankcase chambers 46 to an area above the heads of the pistons 43 when the pistons are at a certain level in the cylinder bores 42 on their downward stroke. This area along with recesses 66 formed in a cylinder head 67 that is affixed to the cylinder block 41 in a known manner form the combustion chambers where the charge is fired by the spark plugs 39 as aforenoted. The burnt charge is discharged from the combustion chambers through exhaust ports (not shown) in a known manner.

The engine is further provided with a cold starting or cold running enrichment system that includes a combined pump and valve assembly, indicated generally by the reference numeral 68. This pump and valve assembly 68 includes a pumping diaphragm 69 that defines a pumping chamber 71 into which fuel is delivered during the pump suction stroke through a one way check valve 72 from the fuel bowl of one of the carburetors through a fuel delivery line 73. The other chamber 74 formed by the diaphragm 69 communicates with the crankcase chamber of one of the cylinders, primarily that with which the pump and valve assembly 68 is associated so as to cause the diaphragm 69 to move back and forth upon pressure variations in the crankcase chamber so as to cause the aforenoted pumping action.

The fuel to the conduit 73 is delivered from a well 76 formed in the body of one of the carburetors 51 and which communicates with its fuel bowl 59 through a restricted metering jet 77. Because of the use of the well 76 and jet 77, initial opening of the valve, which will be described, associated with the enrichment system will cause an initial large amount of fuel delivery while the fuel delivery will then be restricted subsequently due to the interpositioning of the metering jet 77 with the metering jet 77 controlling the amount of fuel that flows to the engine during the cold running enrichment cycle.

The fuel is discharged from the pumping chamber 71 through a one way discharge check valve 78. The delivery of fuel to the engine 23 is, however, controlled by a valve assembly having a construction shown in most detail in FIG. 4. As will be noted in this figure, there is formed within the valve and pump assembly 68 a passageway in which a valve spool 79 reciprocates. The valve spool 79 has a valving member 81 carried by or affixed to its lower end which controls the flow from the pump 71 chamber through a passage 82 to a delivery passage 83. The delivery passage 83 terminates in a fitting 84 to which a conduit 85 is affixed. The conduit 85 delivers the fuel to the spacer 59 and more particularly to either one or more of the balance passages 62, 63 or 64 or directly into the passages 61. By delivering the fuel only to one or more of the balance passages 62 the use of multiple conduits is avoided.

Figure 4:
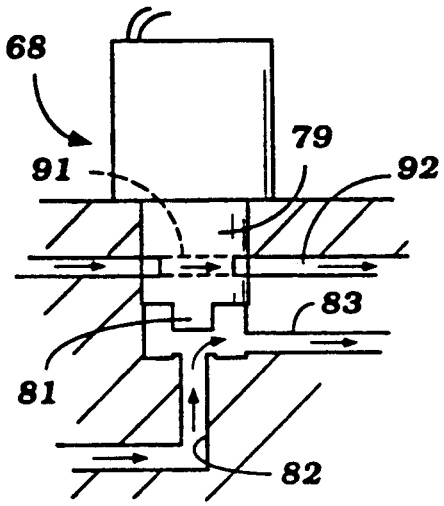
FIG. 4 is an enlarged cross-sectional view showing the enrichment valve of this embodiment in its opened position.

It will be noted that the valve member 79 actually forms the armature of a solenoid having a winding 86 that surrounds a core 87. A coil compression spring 88 normally urges the valve member 79 to a downward or closed position. When the winding 86 is energized, during starting and cold warm-up, the valve member 79 will be drawn to its open position as shown in FIG. 4 and fuel flow to the engine will commence.

In addition to controlling the flow of enrichment fuel to the engine 23, the valve member 79 also controls the flow of enrichment air. For this purpose, there is provided an air metering jet 89 that communicates with the atmosphere and which intersects, when the valve member 79 is in its open position, an annular groove 91 formed in the valve spool 79. This permits air flow to a delivery passage 92 having a fitting 93 at its outer end. The fitting 93 has connected to it a conduit 94 that delivers air to the carburetor induction passages 52 through openings 95 that are positioned downstream of the throttle valves 53 so that it will be insured that there is a good and adequate flow of enrichment air. This will be insured since the air flowing through the outlets 95 is at atmospheric pressure while the pressure in the induction passages 52 downstream of the throttle valves 53 will be at a subatmospheric pressure due to the engine suction.

In addition, the passages 95 are spaced from the fuel discharge passages in the spacer plate 59 so that there is no likelihood that the fuel can flow into the air induction system.

As has been previously noted, the solenoid coil 86 is energized when the engine 23 is first started and during cold warm up in any known manner. In the event the device 68 becomes inoperative, there is provided a manual enrichment control valve 96 that controls the flow of fuel only through a bypass passageway 97. The valve manual 96 includes a valve member 98 that communicates with a seat 99 so as to control the flow through the passageway 97. The valve 96 has a valve operator 101 for moving the valve member 98 from its closed position as shown in FIG. 3 to its open position.

Figure 5:
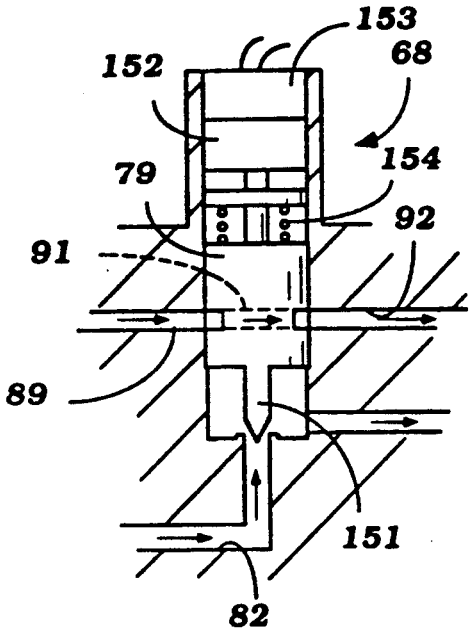
FIG. 5 is a cross-sectional view of an enrichment valve constructed in accordance with another embodiment of the invention and shown in its opened position.
Figure 6:
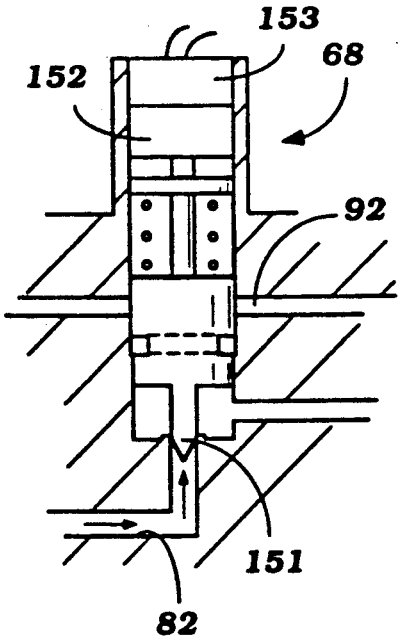
FIG. 6 is a cross-sectional view of the embodiment of FIG. 5 showing the valve in its closed position.

FIGS. 5 and 6 show another embodiment of the invention. This embodiment differs from the embodiment previously described only in the manner of operating the valve member 79 and in that the valve member 79 has a needle portion 151 for controlling the fuel flow. In this embodiment, the valve member 79 is normally in an open position. However, a wax pellet 52 is connected to the valve member 79 and is heated by an electrical heater 153 when the ignition switch is turned on. As the wax pellet 152 heats, the valve element 79 will be moved from its open position as shown in FIG. 5 to a closed position wherein the needle 151 closes the fuel port and the groove 91 moves out of registry with the air passages 89 and 92. A light coil compression spring 154 acts to assist in the closure of the valve member 79.

Figure 7:
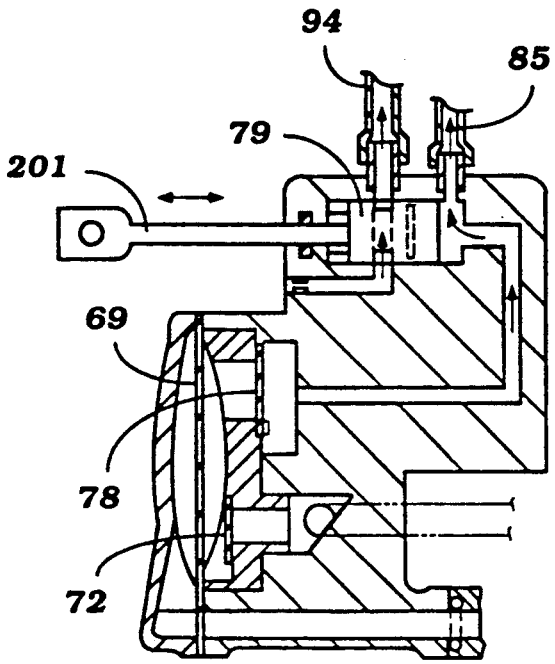
FIG. 7 is a cross-sectional view showing another form of enrichment control valve in its open position.
Figure 8:
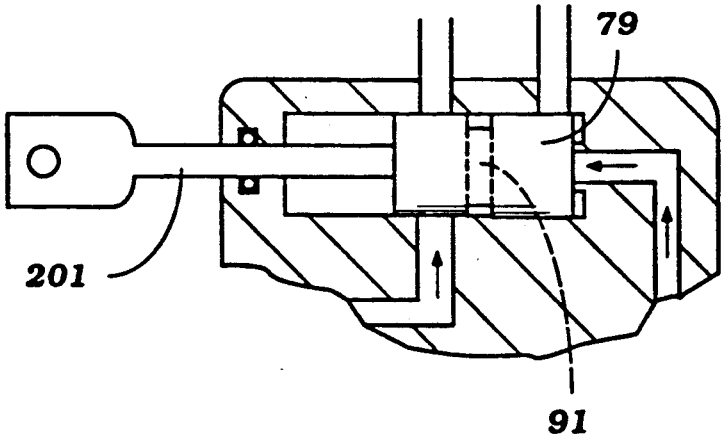
FIG. 8 is an enlarged cross-sectional view of the embodiment of FIG. 7 showing the valve in its closed position.

In the embodiments of the invention as thus far described, the valve member 79 was controlled electrically either by a solenoid coil opening it or an electrically heated wax pellet closing it. FIGS. 7 and 8 show an embodiment which is generally the same as the embodiment of FIGS. 1 through 4 wherein a manual actuator 201 is connected to the valve member 79 so as to effect manual operation of the enrichment as thus far described. With such a manual system, the manual bypass valve 96 of the previously described embodiments is not required.

Figure 9:
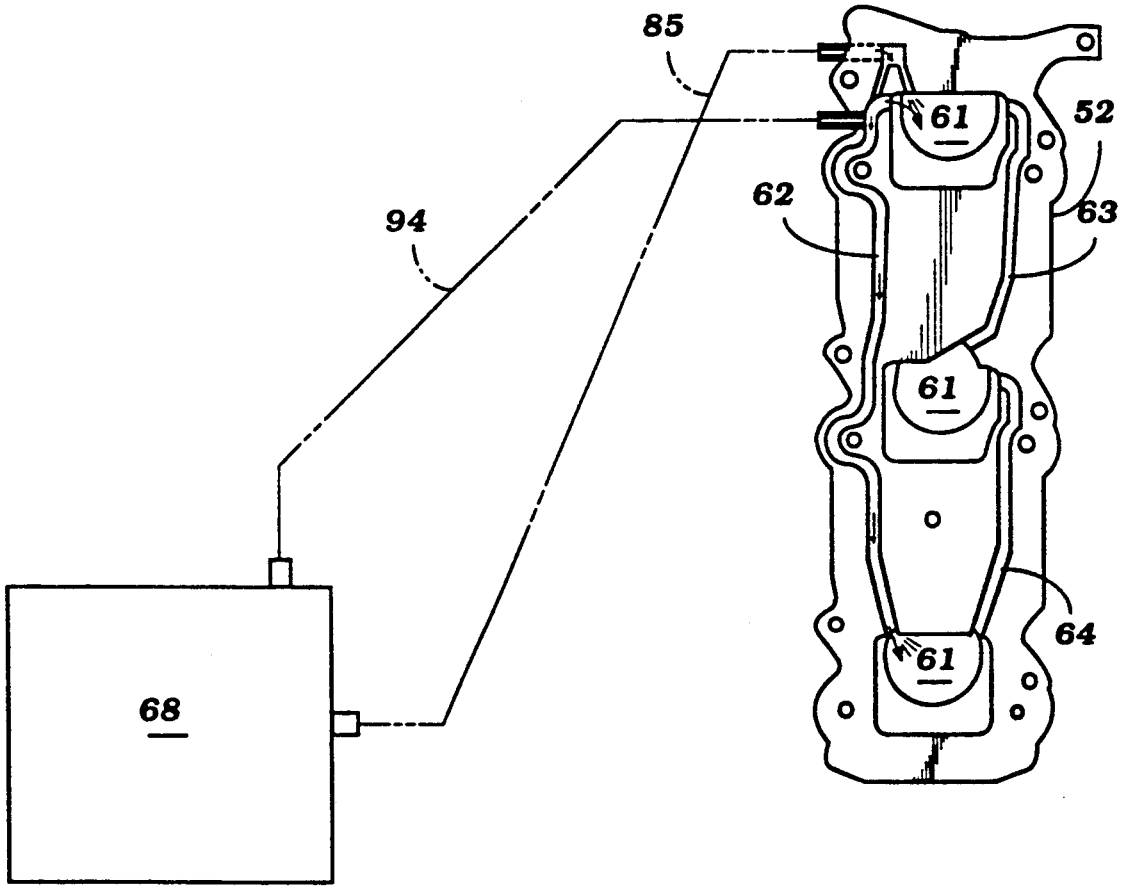
FIG. 9 is a view in part similar to FIG. 3 and shows another embodiment of the invention.

FIG. 9 shows schematically another embodiment of the invention. In this embodiment, the enrichment air as well as the enrichment fuel is supplied to the engine through the spacer plate 52. Preferably, the spacer plate air passages are disposed so that they are not directly adjacent the fuel discharge passages, although there is less likelihood that the fuel will be delivered back into the air passages due to the pressure drop of the fuel that occurs in the line 85.

Figure 10:
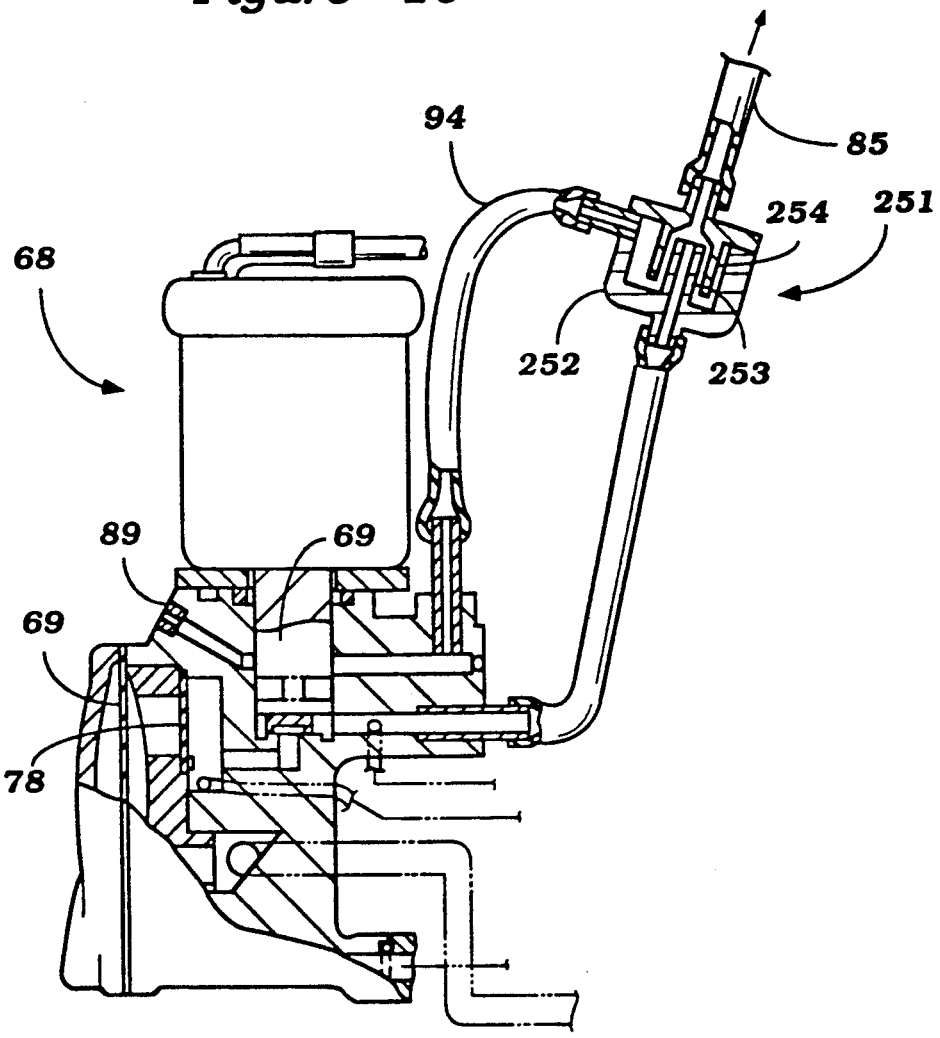
FIG. 10 is a side elevational view, with portions shown in cross-section, of a still further embodiment of the invention.

FIG. 10 shows a still further embodiment of the invention wherein the air is also pressurized slightly for delivery to the engine and is mixed with the fuel. For this purpose, a jet type pumping device, indicated generally by the reference numeral 251 is provided in the conduit 85. The jet pumping device includes an outer housing 252 having a fuel inlet nozzle portion 253 that cooperates with a venturi forming member 254. This action will cause a reduced pressure to exist in the chamber defined by the housing 252 and cause air to drawn in from the conduit 94, mixed with the fuel and slightly pressurized before delivery to the engine.

Figure 11:
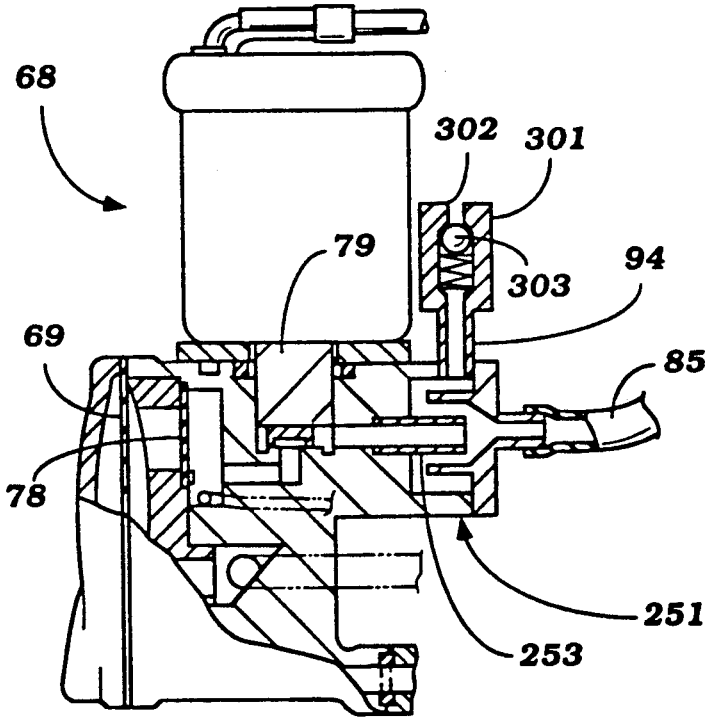
FIG. 11 is a side elevational view, with parts shown in section, of yet another embodiment of the invention.

FIG. 11 shows a still further embodiment of the invention which is generally similar to the embodiment of FIG. 10 except that the jet pumping device 251 is formed directly in the body of the pump and control assembly 68. In this embodiment, a fuel control valve or groove on the valve member 79 is not required. Rather, an air inlet fitting 301 is provided to the conduit 94 and this air inlet fitting includes a metering jet 302 and a ball type check valve 303. The ball check valve 303 is set so that it will normally be closed except when the pump diaphragm 69 is generating pressure in the discharge nozzle 253 and then air will be drawn into the system, mixed with the fuel and delivered to the engine as aforenoted.

From the foregoing description, it should be noted that a number of embodiments of the invention have been illustrated and described, each of which is highly effective in supplying additional fuel under pressure to the engine for enrichment purposes and additional air during the enrichment cycle. Although a number of embodiments of the invention have been illustrated and described, various changes and modifications may be made without departing from the spirit and scope of the invention, as defined by the appended claims.

We claim:

1. An enrichment system for an internal combustion engine having an induction system, a charge forming device for supplying a fuel/air mixture to said induction system, means including first control valve means for selectively supplying enrichment fuel to said induction system at a pressure greater than atmospheric, and means including second control valve means for supplying enrichment air to said induction system at at least atmospheric pressure in response to the supply of enrichment fuel, said first and said second control valve means comprising a common member for controlling both fuel and air flow.

2. An enrichment system as set forth in claim 1 wherein the means for supplying enrichment fuel further includes pumping means separate from the charge forming device for pumping the fuel to the engine.

3. An enrichment system as set forth in claim 2 wherein the fuel for enrichment is supplied from the charge forming means.

4. An enrichment system as set forth in claim 3 wherein the control valve means are both opened on starting of the engine.

5. An enrichment system as set forth in claim 3 wherein the control valve means are both opened upon low temperature running.

6. An enrichment system as set forth in claim 5 wherein the control valve means are both closed after the engine has run for a time period.

7. An enrichment system as set forth in claim 1 further including means for pressuring the air delivered to the engine for enrichment.

8. An enrichment system as set forth in claim 7 wherein the enrichment air is mixed with the pressurized fuel in a jet pumping device for pressurization of the air by the pressurized fuel flow.

9. An enrichment system as set forth in claim 1 wherein the enrichment air is supplied to an area in the induction system that is at a lower than atmospheric pressure.

10. An enrichment system as set forth in claim 1 wherein the common member is solenoid operated.

11. An enrichment system as set forth in claim 1 wherein the common member is normally maintained in an opened position and is closed by a heating device that supplies heat when the engine is switched on for closing the valve after a predetermined time period.

12. An enrichment system for an internal combustion engine having an induction system, a charge forming device for supplying fuel/air mixture to said induction system, pumping means for pumping fuel under pressure, means including first control valve means for selectively supplying a pressurized flow of said pumped fuel to said induction system at a pressure greater than atmospheric, and means including second control valve means for supplying enrichment air for mixture with the pressurized fuel and delivery to said induction system at at least atmospheric pressure.

13. An enrichment system as set forth in claim 12 wherein the fuel for enrichment is supplied from the charge forming means.

14. An enrichment system as set forth in claim 13 wherein the enrichment fuel is supplied on starting of the engine.

15. An enrichment system as set forth in claim 13 wherein the enrichment fuel is supplied for low temperature running.

16. An enrichment system as set forth in claim 15 wherein the enrichment fuel supply is stopped after the engine has run for a time period.

17. An enrichment system as set forth in claim 12 wherein the enrichment air is mixed with the fuel in a jet pumping device.

* * * * *